US005395653A

United States Patent [19]

Baum

[11] Patent Number: 5,395,653

[45] Date of Patent: Mar. 7, 1995

[54] APPARATUS AND METHOD FOR CONTROLLING COATING FROWNS IN HOPPER COATING

[75] Inventor: William Baum, Rochester, N.Y.

[73] Assignee: Eastman Kodak Company, Rochester, N.Y.

[21] Appl. No.: 217,398

[22] Filed: Mar. 24, 1994

[51] Int. Cl.[6] ..... B05D 3/12

[52] U.S. Cl. ..... 427/356; 427/420; 118/411; 118/324; 118/DIG. 4; 425/461

[58] Field of Search ..... 427/420, 356; 118/411, 118/324, DIG. 4; 425/461

[56] References Cited

U.S. PATENT DOCUMENTS

| | | | |
|---|---|---|---|
| 3,299,195 | 1/1967 | Chenoweth et al. | 118/DIG. 4 |
| 3,823,053 | 7/1974 | Straub et al. | 156/500 |
| 3,825,645 | 7/1974 | Fayet | 264/177 |
| 4,043,739 | 8/1977 | Appel | 425/461 |
| 4,348,346 | 9/1982 | Thompson | 264/146 |
| 4,389,181 | 6/1983 | Frick | 425/461 |
| 4,536,362 | 8/1985 | Donaldson | 264/171 |
| 4,623,501 | 11/1986 | 425izaki | 461/ |
| 4,708,629 | 11/1987 | Kasamatsu | 118/411 |
| 5,234,500 | 8/1993 | Korokeyi | 118/DIG. 4 |

*Primary Examiner*—Shrive Beck
*Assistant Examiner*—Katherine A. Bareford
*Attorney, Agent, or Firm*—Carl F. Ruoff

[57] ABSTRACT

The present invention relates to dual cavity hoppers and is an apparatus and method for controlling frowns. The dual cavity hoppers are provided with adjustable bypass means for providing fluid from the inner cavity to the outer cavity or alternatively for providing fluid directly to the outer cavity. The bypass means can be used on end-fed or center-fed dual cavity hoppers. The uniformity of the laydown across the width of the delivery slot is improved.

18 Claims, 6 Drawing Sheets

FIG. 4
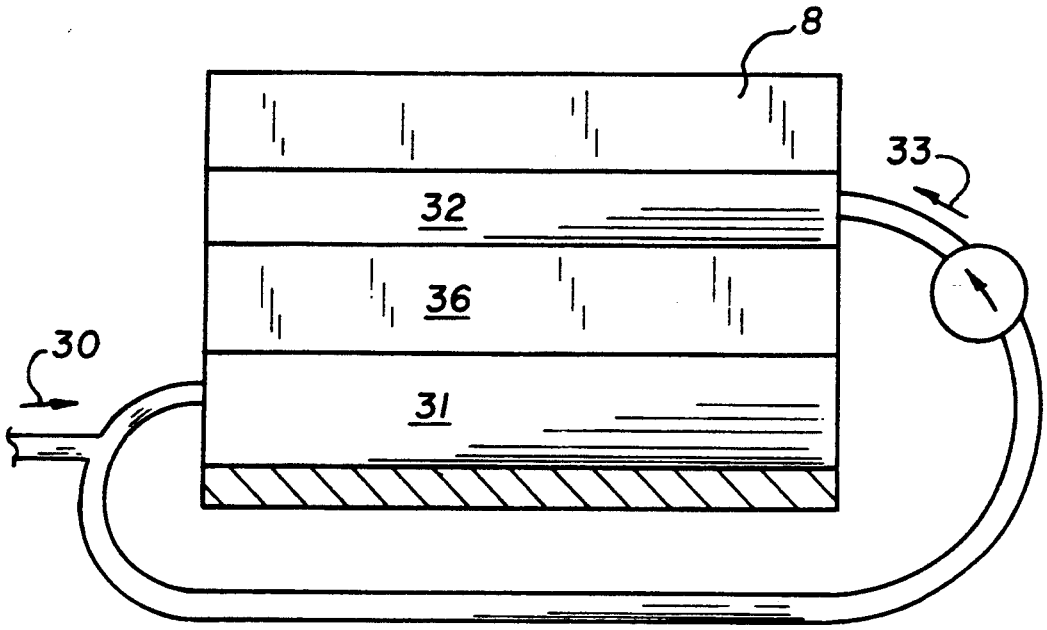
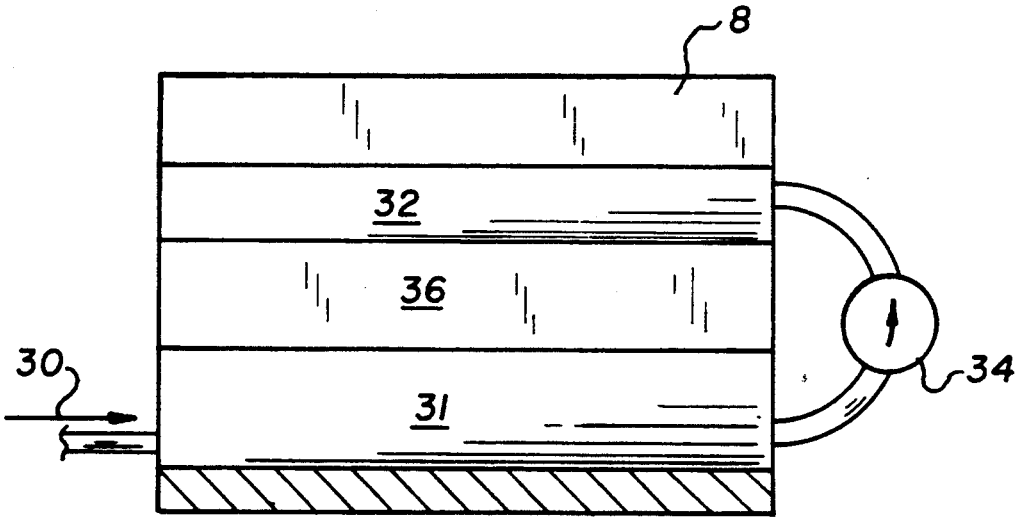
FIG. 5

APPARATUS AND METHOD FOR CONTROLLING COATING FROWNS IN HOPPER COATING

FIELD OF THE INVENTION

The present invention relates to coating hoppers and allows hoppers greater flexibility to coat uniformly over a wide range of flow conditions and rheologies. More particularly, the present invention can be applied to new hoppers or retrofitted on existing hoppers.

BACKGROUND OF THE INVENTION

The coating frown is a common width-wise uniformity defect caused by too little flow being distributed to the ends of a hopper away from the inlet. The coating frown is a distribution, in the case of a center-fed hopper, where there is more laydown of the coating composition in the center than at the two ends, resulting in the frown shape. For an end-fed hopper, the frown is one-sided, with less laydown away from the inlet.

The frown profile can result from any geometry of cavity and slot. The two extremes of geometry are the straight, untapered inner cavity 10 as shown in FIGS. 1 and 2, and the coat hanger inner cavity shown in FIG. 3. The straight cavity 10 is a general purpose cavity for coating a variety of fluids and flow rates, whereas the tapered coat hanger cavity 20 is less flexible, often optimized for a particular flow condition and particular theology of the coating composition. The coat hanger cavity 20 also has less fluid stagnation than the straight cavity. In FIGS. 1–3, the inner cavity is in communication with the outer cavity 11 through communication slot 13. The coating composition is discharged through metering slot 8.

The frown profile occurs because of the transverse pressure drop in the cavity. It occurs in the tapered cavity hopper when the flow condition deviates from design flow condition. Additionally, it occurs when the rheology of the coating solution deviates from the design rheology. FIGS. 1–3 show an end-fed hopper where the coating composition is introduced at one end of the hopper 12. However, the coating frown discussed earlier occurs in a center-fed hopper, as there is a transverse pressure drop in the cavity from the center to each end of the cavity.

The present invention eliminates or minimizes the frown profile by providing an adjustment or control feature on the hopper.

SUMMARY OF THE INVENTION

The present invention is a coating apparatus for supplying a coating composition to a web which includes a coating hopper having an inner cavity and an outer cavity, each cavity having a first end and a second end, the inner cavity and the outer cavity in fluid communication through a communication slot extending from a first side of the hopper to a second side of the hopper, the hopper having a metering slot in fluid communication with the outer cavity. Means for supplying coating composition to the inner cavity at a position between the first side and the second side of the hopper is provided. A first and second adjustable bypass means for supplying coating composition from (a) the first end of the inner cavity to the first end of the outer cavity, and (b) from the second end of the inner cavity to the second end of the outer cavity is also provided.

The present invention also includes the method of using the apparatus.

BRIEF DESCRIPTION OF THE DRAWINGS

FIG. 4 shows a two-cavity, end-fed hopper including an adjustable bypass to the outer cavity.

FIG. 5 shows an alternate embodiment of a two-cavity, end-fed hopper including an adjustable bypass to the outer cavity.

Figure 1:
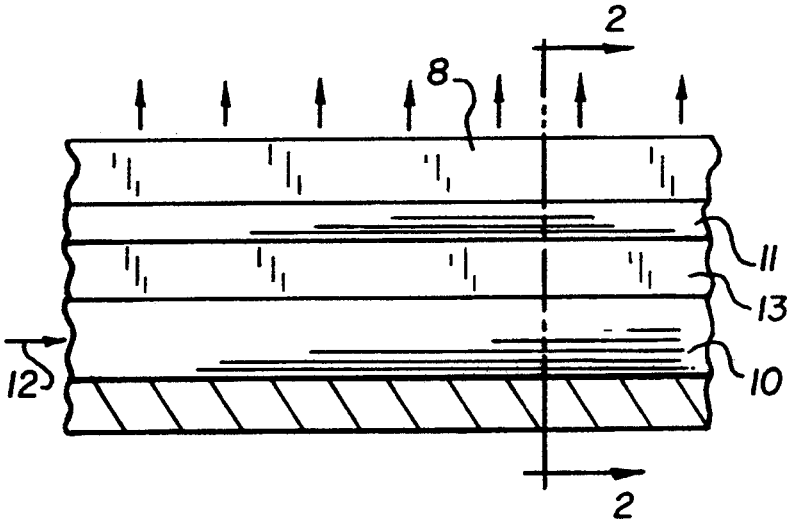
FIG. 1 (PRIOR ART)
FIG. 1 shows a prior art two-cavity, end-fed hopper.
Figure 3:
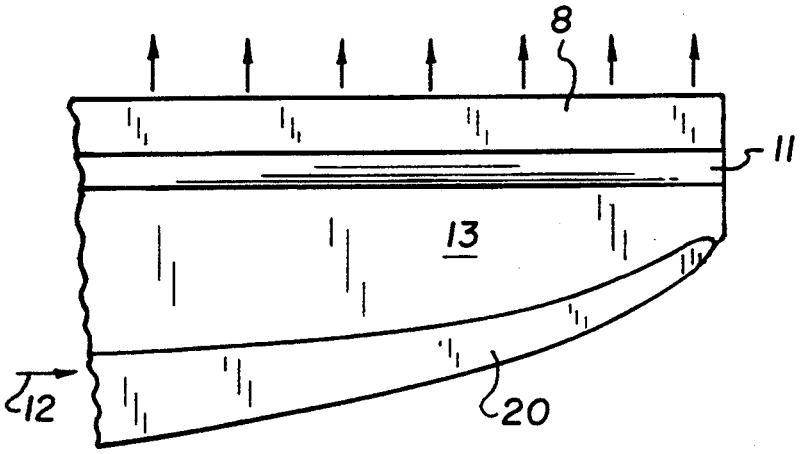
FIG. 3 (PRIOR ART)
FIG. 3 shows a prior art tapered two-cavity, end-fed hopper.
Figure 2:
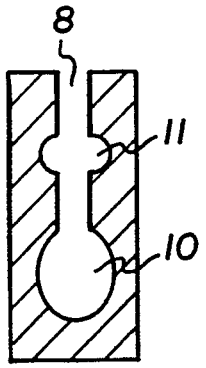
FIG. 2 (PRIOR ART)
FIG. 2 shows a sectional view along 2—2 of FIG. 1.

For a better understanding of the present invention together with other objects, advantages and capabilities thereof, reference is made to the following description and appended claims in connection with the above-described drawing.

DETAILED DESCRIPTION OF THE PREFERRED EMBODIMENTS

FIGS. 4 and 5 show two embodiments of the present invention. In both these figures an end-fed, dual-cavity hopper is shown. The hoppers are fed through conduit 30 from the left end to the inner cavity 31. The inner cavity 31 is in fluid communication with the outer cavity 32 through communication slot 36. Although straight cavities are shown in both figures, it should be understood that the cavities can be straight, tapered or any other geometry in-between.

To control the frown, FIG. 4 shows an additional inlet 33 providing flow to the right end of the outer cavity 32. Some of the total flow of the coating solution is diverted to the outer cavity feed, reducing somewhat the flow into the primary inlet. For different degrees of coating frown, depending upon the product and flow conditions being coated, different amounts of the total flow diverted to the outer cavity are required. Alternatively, the flow into the outer cavity can be provided by a separate source altogether.

FIG. 5 shows that the flow to the outer cavity 32 can also be provided from the right end of the inner cavity 31. A conduit has an adjustable valve 34 which removes fluid from the right end of the inner cavity 31 and channels it to the outer cavity 32. In this case the solution flow rate to the primary inlet is unchanged.

Figure 6:
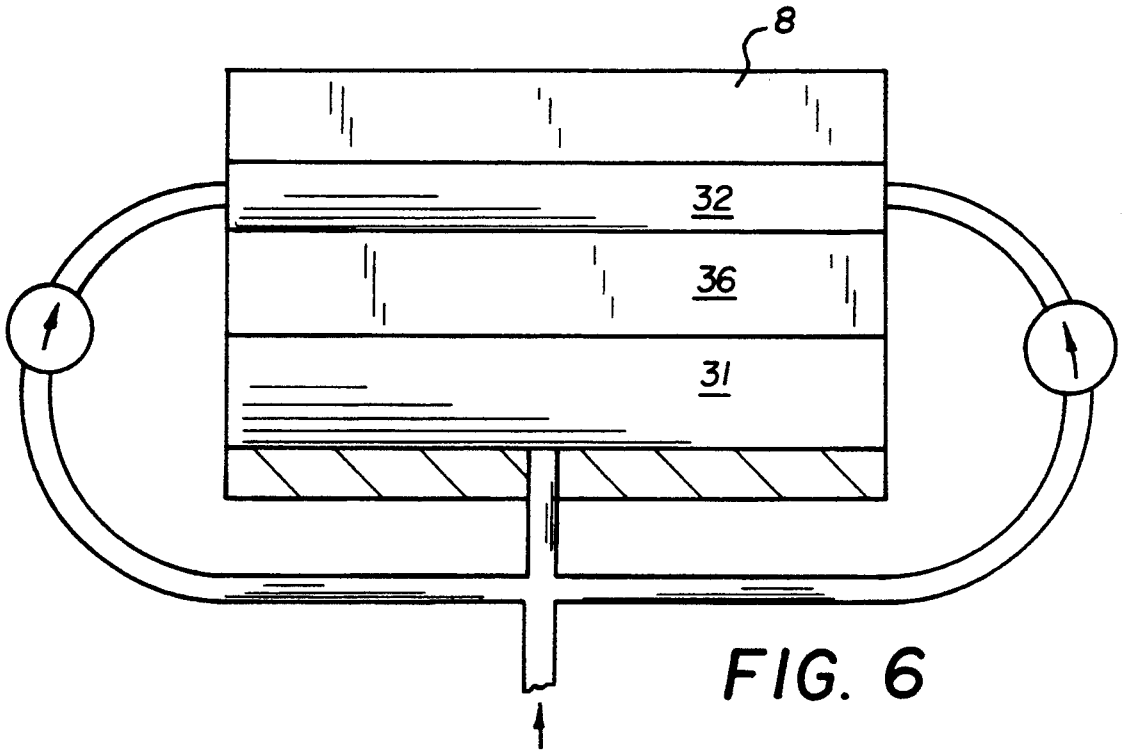
FIG. 6 shows a two-cavity, center-fed hopper, including adjustable bypass to the outer cavity.
Figure 7:
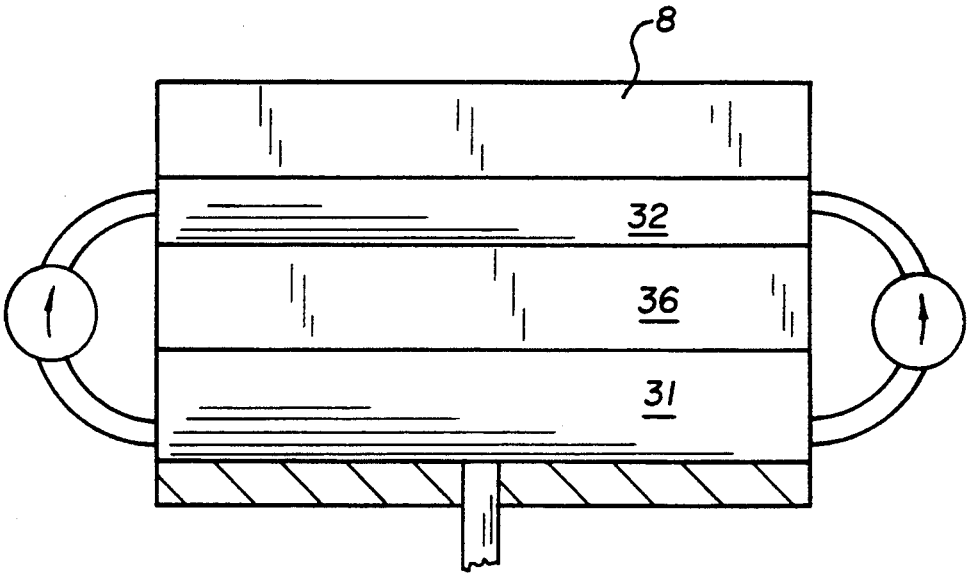
FIG. 7 shows an alternate embodiment of a two-cavity, center-fed hopper, including an adjustable bypass to the outer cavity.

As the degree of coating frown changes, the amount of flow provided to the outer cavity needs to be adjusted or controlled. Shown schematically in FIGS. 4 and 5, this can be done in a variety of ways, somewhat dependent upon how frequently the outer cavity flow needs to be adjusted. If continuous control is needed, some sort of valve may be necessary. If, however, the adjustment will be between coating events, the use of orifices or other interchangeable components are possible. These components would be fixed in their individual flow resistance but interchangeable to provide different amounts of flow to the outer cavity. Because the pressure in the outer cavity is always lower than the inner cavity, it is not strictly necessary to use a pump to supply the flow. FIGS. 6 and 7 show the concepts of FIGS. 4 and 5 as applied to a center-fed hopper. As earlier, these cavities can be of any geometry. Although these figures show two adjustments at the two ends of the hopper, it is also possible to use a single adjustment to assure equal flow to the two ends of the outer cavity.

Figure 8:
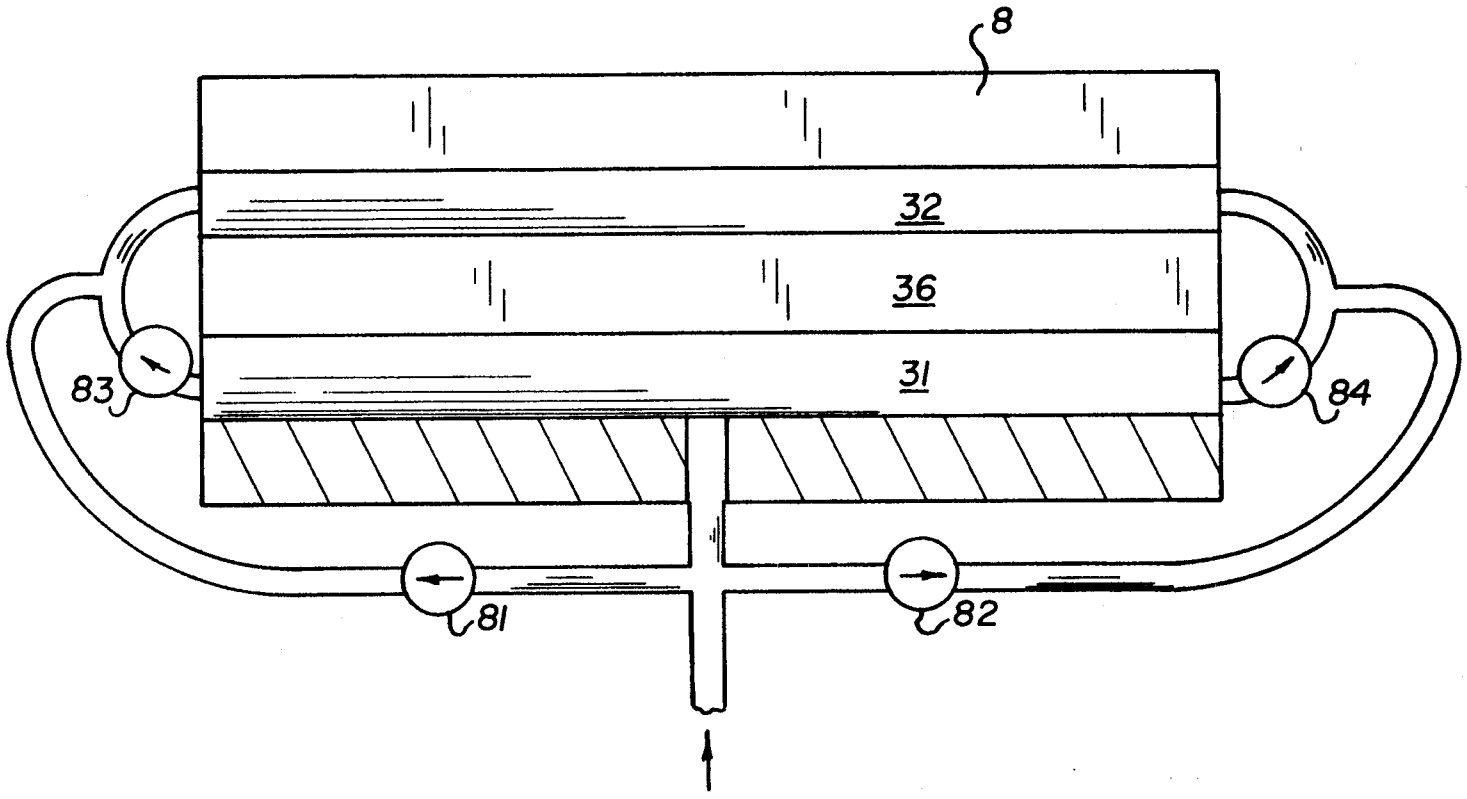
FIG. 8 shows an experimental set-up used to test the present invention.

An experimental set-up as shown in FIG. 8 was used to test the frown control apparatus shown in FIGS. 6 and 7. When valves 81 and 82 are open and valves 83 and 84 are closed, the set-up corresponds to FIG. 6 and is referred to as external frown control. When valves 83 and 84 are open and valves 81 and 82 are closed, the set-up corresponds to FIG. 7 and is referred to as internal frown control.

EXAMPLES

The following examples and figures show the improvement in coating that is possible when using the present invention. A test set-up was constructed which allowed external frown control (FIG. 6) or internal frown control (FIG. 7). The hopper was provided with a pressure bar which measured the pressure across the metering slot 8. The coating composition used was glycerin having a viscosity of 11.5 cP, a specific gravity of 1.16 and a flowrate of 0.47 cc/cm-sec. Pressure profiles are provided in FIG. 9.

Figure 9:
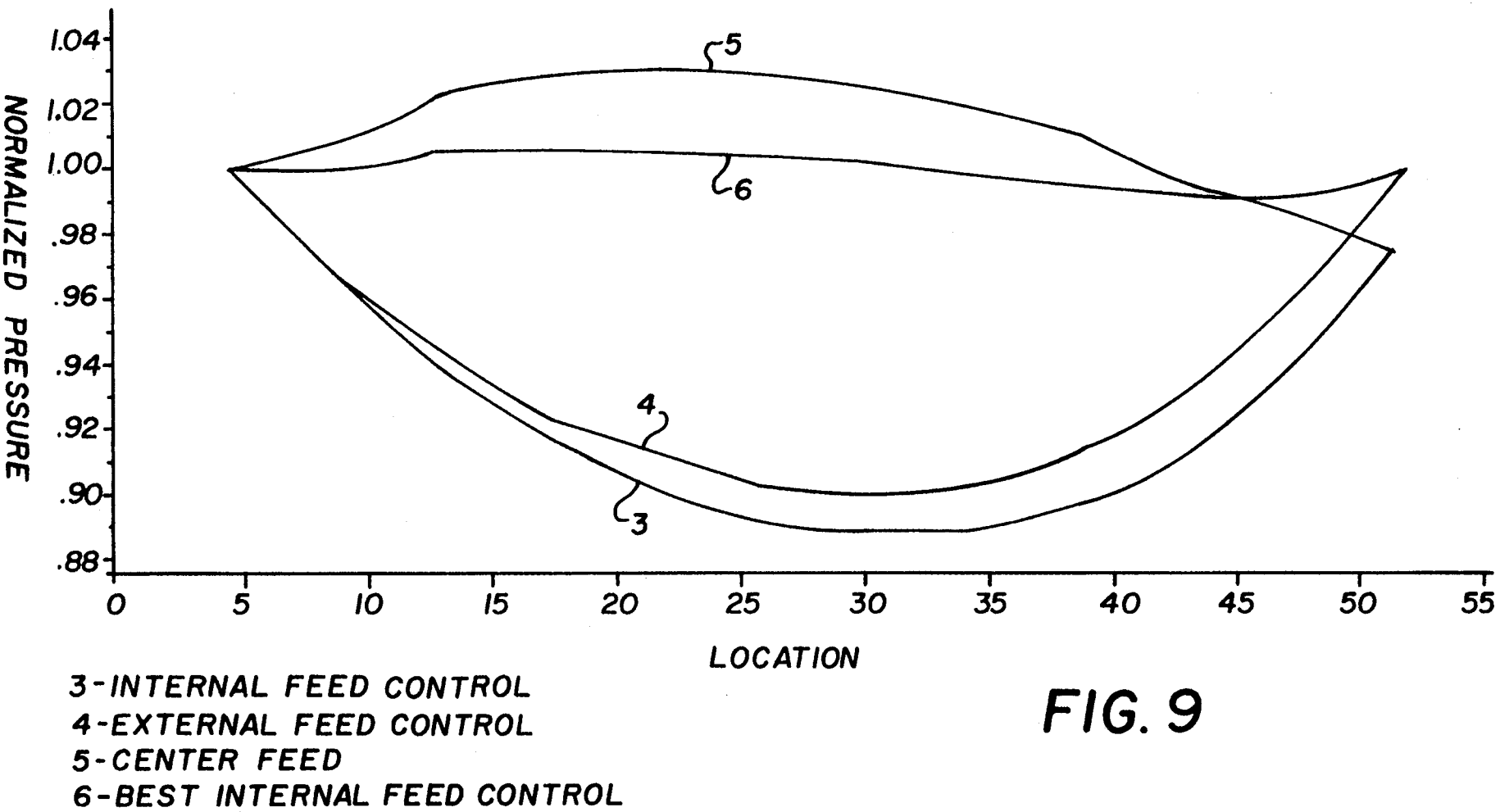
FIG. 9 shows the results of tests of the present invention.

FIG. 9 shows the results of the pressure profiles obtained for a center fed with no frown control; internal frown control and external frown control and the best internal frown control obtained. The pressure profiles show that a frown appears for the center fed hopper when there is no frown control practiced. In the extreme cases of frown control, either internal or external, "smiles" appear.

When the total feed was center fed with no feed control to the outer cavity, an outer cavity frown appears. This is shown as line 5. For the set-up used in external frown control approximately 33% of the total flow went through each bypass, leaving 34% of the total flow through the inner slot. This is shown as line 4. For internal frown control approximately 40% of the total flow went through each bypass leaving only 20% of the total flow through the inner slot. This is shown as line 3.

Highlighted in FIG. 9 is the comparison of the center fed uniformity to the best uniformity that could be produced with internal frown control. This is shown as line 6. In this case the valves were adjusted while observing the uniformity on the pressure bar. This shows that an initial frown of 5.5% was reduced to a profile with total uniformity variation of 1.2%.

These experiments show that using frown control and adjusting the bypass to the product conditions, a more uniform coating can be realized.

Figure 10:
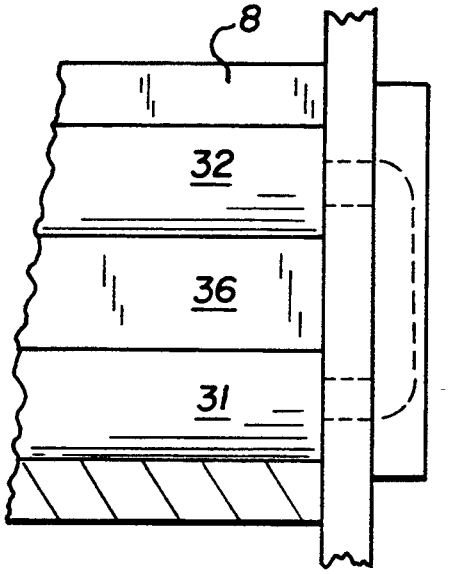
FIG. 10 shows a sectional view of an adjustable bypass from the inner cavity to the outer cavity.
Figure 11:
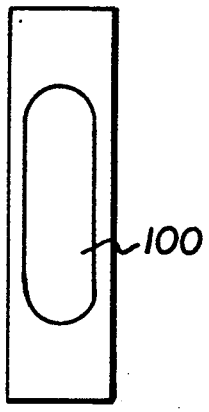
FIG. 11 shows a front view of the plate used with FIG. 10.
Figure 12:
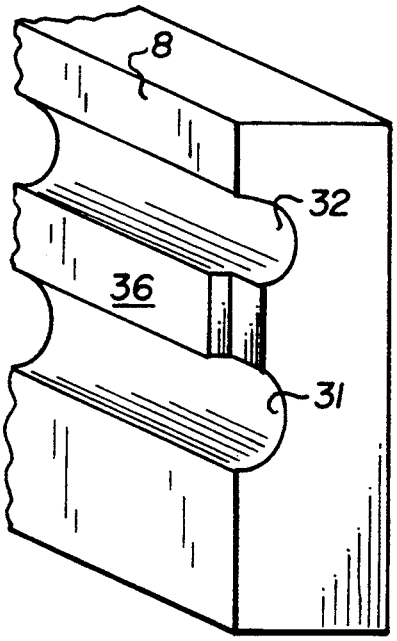
FIG. 12 shows a perspective view of an alternate bypass from the inner cavity to the outer cavity.

FIGS. 10–12 show two alternate embodiments of providing a bypass from the inner cavity to the outer cavity. FIGS. 10 and 11 show the use of small interchangeable plates, each having a fixed passageway. A number of these plates, perhaps 3–5, could be made, each with different sized passageways. The plates would be changed as needed on product changes, replacing the function of valves. Which plates to use would be part of the coating instructions. Multiple adjoining plates could be used to control several slots, or combined into one plate if desired. The low pressures involved allow the plates to be held in place by spring action with bolting unnecessary. FIG. 12 shows a perspective view of an example where the passageway between the cavities is created by relieving the outer slot at the end of the hopper bars. The external control settings will be created by interchangeable external plates which would determine the final cross-sectional area of the passageway by their degree of intrusion and blockage of the passageway. This concept is a simple system to implement on existing hoppers.

While there has been shown and described what are present considered the preferred embodiments of the invention, it will be obvious to those skilled in the art that various alterations and modifications may be made therein without departing from the scope of the invention.

What is claimed is:

1. A method of supplying a coating composition to a moving support comprising:

(a) providing a coating hopper having an inner cavity and an outer cavity, each cavity having a first end at a first side of the coating hopper and a second end at a second side of the coating hopper, the inner cavity and the outer cavity in fluid communication through a communication slot extending from the first side of the hopper to the second side of the hopper, the hopper having a supply slot in fluid communication with the outer cavity supplying the coating composition to the moving support;

(b) supplying the coating composition to the inner cavity at the first end; and (c) adjustably supplying the coating composition to the second end of the outer cavity.

2. A method of applying a coating composition to a moving support comprising:

(a) providing a coating hopper having an inner cavity and an outer cavity, each cavity having a first end at a first side of the coating hopper and a second end at a second side of the coating hopper, the inner cavity and outer cavity in fluid communication through a communication slot extending from the first side of the hopper to the second side of the hopper, the hopper having a supply slot in fluid communication with the outer cavity supplying the coating composition to the moving support;

(b) supplying the coating composition to the inner cavity between the first end and the second end;

(c) providing a first adjustable fluid bypass from the first end of the inner cavity to the first end of the outer cavity; and (d) providing a second adjustable fluid bypass from the second end of the inner cavity to the second end of the outer cavity.

3. A method of supplying a coating composition to a moving support comprising:

(a) providing a coating hopper having an inner cavity and an outer cavity, each cavity having a first end at a first side of the coating hopper and a second end at a second side of the coating hopper, the inner cavity and the outer cavity in fluid communication through a communication slot extending from the first side of the hopper to the second side of the hopper, the hopper having a supply slot in fluid communication with the outer cavity supplying the coating composition to the moving support;

(b) supplying the coating composition to the inner cavity at the first end; and (c) adjustably supplying the coating composition from the second end of the inner cavity to the second end of the outer cavity.

4. A method of applying a coating composition to a moving support comprising:

(a) providing a coating hopper having an inner cavity and an outer cavity, each cavity having a first end at a first side of the coating hopper and a second end at a second side of the coating hopper, the inner cavity and outer cavity in fluid communication through a communication slot extending from the first side of the hopper to the second side of the hopper, the hopper having a supply slot in fluid communication with the outer cavity for supplying the coating composition to the moving support;

(b) supplying the coating composition to the inner cavity between the first end and the second end from a first means;

(c) supplying the coating composition to the first end of the outer cavity from a second means; and (d) supplying the coating composition to the second end of the outer cavity from a third means.

5. A coating apparatus for supplying a coating composition to a web comprising:

(a) a coating hopper having an inner cavity and an outer cavity, each cavity having a first end at a first side of the coating hopper and a second end at a second side of the coating hopper, the inner cavity and the outer cavity in fluid communication through a communication slot extending from the first side of the hopper to the second side of the hopper, the hopper having a metering slot in fluid communication with the outer cavity for supplying the coating composition to the web;

(b) means for supplying the coating composition to the first end of the inner cavity; and (c) adjustable bypass means for supplying the coating composition from the second end of the inner cavity to the second end of the outer cavity.

6. The apparatus according to claim 5 wherein said adjustable bypass means comprises:

a conduit and a valve having a first position which prohibits flow through the conduit, and a second position which permits flow through the conduit.

7. The apparatus according to claim 5 wherein the inner cavity tapers from the first side of the hopper to the second side of the hopper.

8. The apparatus according to claim 5 wherein said adjustable bypass means comprises:

a passageway having an adjustable restriction positioned at the second side of the hopper.

9. A coating apparatus for supplying a coating composition to a web comprising:

(a) a coating hopper having an inner cavity and an outer cavity, each having a first end at a first side of the coating hopper and a second end at a second side of the coating hopper, the inner cavity and outer cavity in fluid communication through a communication slot extending from the first side of the hopper to the second side of the hopper, the hopper having a metering slot in fluid communication with the outer cavity for supplying the coating composition to the web;

(b) means for supplying the coating composition to the inner cavity at a position between the first side and second side of the hopper;

(c) first adjustable bypass means for supplying the coating composition from the first end of the inner cavity to the first end of the outer cavity; and (d) second adjustable bypass means for supplying the coating composition from the second end of the inner cavity to the second end of the outer cavity.

10. The apparatus according to claim 9 wherein the inner cavity tapers from the position between the first side and second side of the hopper to the first side of the hopper and to the second side of the hopper.

11. The apparatus according to claim 9 wherein said first adjustable means comprises:

a passageway having an adjustable restriction positioned at the first side of the hopper and in fluid communication with the outer cavity and the inner cavity.

12. The apparatus according to claim 9 wherein said second adjustable means comprises:

a passageway having an adjustable restriction positioned at the second side of the hopper and in fluid communication with the outer cavity and the inner cavity.

13. A coating apparatus for supplying a coating composition to a web comprising:

(a) a coating hopper having an inner cavity and an outer cavity, each cavity having a first end at a first side of the coating hopper and a second end at a second side of the coating hopper, the inner cavity and outer cavity in fluid communication through a communication slot extending from the first side of the hopper to the second side of the hopper, the hopper having a metering slot in fluid communication with the outer cavity for supplying the coating composition to the web;

(b) means for supplying the coating composition to the inner cavity at the first end; and (c) adjustable means for supplying the coating composition to the second end of the outer cavity.

14. The apparatus according to claim 13 wherein said adjustable means comprises:

(a) a conduit; and (b) a valve having a first position which prohibits flow through the conduit and a second position which permits flow through the conduit.

15. The apparatus according to claim 13 wherein the inner cavity tapers from the first side of the hopper to the second side of the hopper.

16. A coating apparatus for supplying a coating composition to a web comprising:

(a) a coating hopper having an inner cavity and an outer cavity, each cavity having a first end at a first side of the coating hopper and a second end at a second side of the coating hopper, the inner cavity and outer cavity in fluid communication through a communication slot extending from the first side of the hopper to the second side of the hopper, the hopper having a metering slot in fluid communication with the outer cavity for supplying the coating composition to the web;

(b) first means for supplying the coating composition to the inner cavity am a position between the first end and the second end;

(c) second means for supplying the coating composition to the first end of the outer cavity; and (d) third means for supplying the coating composition to the second end of the outer cavity.

17. The apparatus according to claim 16 wherein the inner cavity tapers from the position between the first side and the second side of the hopper to the first side of the hopper and to the second side of the hopper.

18. The coating apparatus according to claim 16 wherein said second and third means for supplying coating composition are adjustable.

* * * * *